US011725297B2

(12) United States Patent
Shimomura et al.

(10) Patent No.: US 11,725,297 B2
(45) Date of Patent: Aug. 15, 2023

(54) PLATING APPARATUS

(71) Applicant: EBARA CORPORATION, Tokyo (JP)

(72) Inventors: Naoki Shimomura, Tokyo (JP); Mizuki Nagai, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/504,127

(22) Filed: Oct. 18, 2021

(65) Prior Publication Data

US 2022/0119981 A1 Apr. 21, 2022

(30) Foreign Application Priority Data

Oct. 20, 2020 (JP) ..... 2020-175956

(51) Int. Cl.
*C25D 17/00* (2006.01)
*C25D 17/10* (2006.01)
*C25D 17/02* (2006.01)

(52) U.S. Cl.
CPC ..... *C25D 17/10* (2013.01); *C25D 17/007* (2013.01); *C25D 17/02* (2013.01)

(58) Field of Classification Search
None
See application file for complete search history.

(56) References Cited

U.S. PATENT DOCUMENTS 5,620,581 A 4/1997 Ang
2012/0043216 A1* 2/2012 Arvin ..... C25D 17/12 204/287
2014/0083862 A1* 3/2014 Harris ..... C25D 17/001 204/278
2016/0305038 A1* 10/2016 McHugh ..... C25D 17/005

OTHER PUBLICATIONS

English translation WO 2008094838, Woodruff et al. Aug. 7, 2008 (Year: 2008).*
English translation KR 10-2007-0041227. (Year: 2007).*

* cited by examiner

*Primary Examiner* — Stefanie S Wittenberg
(74) *Attorney, Agent, or Firm* — BakerHostetler

(57) ABSTRACT

A plating apparatus including a thief electrode that can be suitably maintained is provided. The plating apparatus includes a substrate holder holding a substrate, a thief electrode supporter supporting a thief electrode to be disposed outside the substrate, a plating tank configured to immerse the substrate in a plating solution for applying an electroplating treatment, a thief electrode maintenance tank configured to perform maintenance of the thief electrode, and a transport module configured to transport the thief electrode supporter to the plating tank and the thief electrode maintenance tank.

8 Claims, 7 Drawing Sheets

100

37
120
120A
38
39
120B
LOAD
UNLOAD
40b
40
40a
36
35
34
33
32
30
29
27
110
50a
50
26B(26)
26A(26)
24
25a
25
175
175C
175B
175A

PLATING APPARATUS

TECHNICAL HELD

The present invention relates to a plating apparatus.

BACKGROUND ART

Heretofore, a wiring has been formed in a fine wiring groove, hole or resist opening provided in a surface of a substrate such as a semiconductor wafer, and a bump (protruding electrode) to be electrically connected to an electrode of a package or the like has been formed on the surface of the substrate. As a method of forming this wiring and bump, for example, an electroplating method, an evaporation method, a printing method, a ball bump method or the like is known. With increase in the number of I/O of semiconductor chips and for a finer pitch, the electroplating method is becoming often used in which miniaturization is possible and performance is relatively stable.

In a case of forming the wiring or the bump by the electroplating method, a seed layer (power supply layer) with low electrical resistance is formed on a surface of a barrier metal provided in the wising groove, hole or resist opening in the substrate. In the surface of this seed layer, a plating film grows.

In general, the substrate to be plated includes an electric contact in a peripheral edge portion. That is, current flows from a center to the peripheral edge portion of the substrate to be plated. As a distance from the center of the substrate increases, a potential gradually drops by an amount due to electrical resistance of the seed layer, and a lower potential is generated in the peripheral edge portion of the substrate than in a central portion of the substrate. A phenomenon where reduction current of metal ions, that is, plating current concentrates on the peripheral edge portion of the substrate due to a potential difference between the substrate center and the peripheral edge portion is called terminal effect.

Heretofore, as an example of a method of decreasing nonuniformity in film thickness of the plating film due to the terminal effect, a method has been performed, the method including providing, outside the substrate, a dummy electrode to be plated called a thief electrode, and dispersing electricity flowing through an outer periphery of the substrate, to decrease a plating amount in the peripheral edge portion of the substrate.

CITATION LIST

Patent Literature

PTL 1: U.S. Pat. No. 5,620,581

SUMMARY OF INVENTION

Technical Problem

In a case of providing a plating apparatus with a thief electrode, if the thief electrode continues to be used in a plating tank for a long period of time, copper plating adhered on the thief electrode might peel off in the plating tank. Such falling of copper plating into the plating tank causes, for example, deterioration of an additive in a plating solution. There is also concern that precipitation of a black film on the surface of copper adhered on the thief electrode causes contamination of the plating solution. Consequently, it is preferable to maintain or change the thief electrode every predetermined period. However, it is laborious to manually maintain or change the thief electrode. It is also considered that to remove copper or the like adhered on the thief electrode, for example, a chemical solution is applied to act on the thief electrode, or that the thief electrode is immersed in the plating solution and subjected to reverse electrolysis. However, in a case where the thief electrode is integrally disposed in a substrate holder holding the substrate, if the substrate holder is exposed together with the thief electrode to the chemical solution, plating solution or the like for a long time, deterioration or damages on the substrate holder might be caused.

The present invention has been made in view of the above described situations, and an object thereof is to provide a plating apparatus including a thief electrode that can be suitably maintained.

Solution to Problem

According to an embodiment of the present invention, a plating apparatus is provided, and this plating apparatus includes a substrate holder holding a substrate, a thief electrode supporter supporting a thief electrode to be disposed outside the substrate, a plating tank configured to immerse the substrate in a plating solution for applying an electroplating treatment, a thief electrode maintenance tank configured to perform maintenance of the thief electrode, and a transport module configured to transport the thief electrode supporter to the plating tank and the thief electrode maintenance tank.

DESCRIPTION OF EMBODIMENTS

Hereinafter, description will be made as to an embodiment of the present invention with reference to the drawings. However, the drawings for use are schematic views. Therefore, a size, position, shape and the like of each shown component may be different from a size, position, shape and the like in an actual apparatus. Also, in the following description and the drawings for use in the following description, parts that may be configured identically are denoted with the same reference sign, and redundant description is not repeated.

Figure 1:
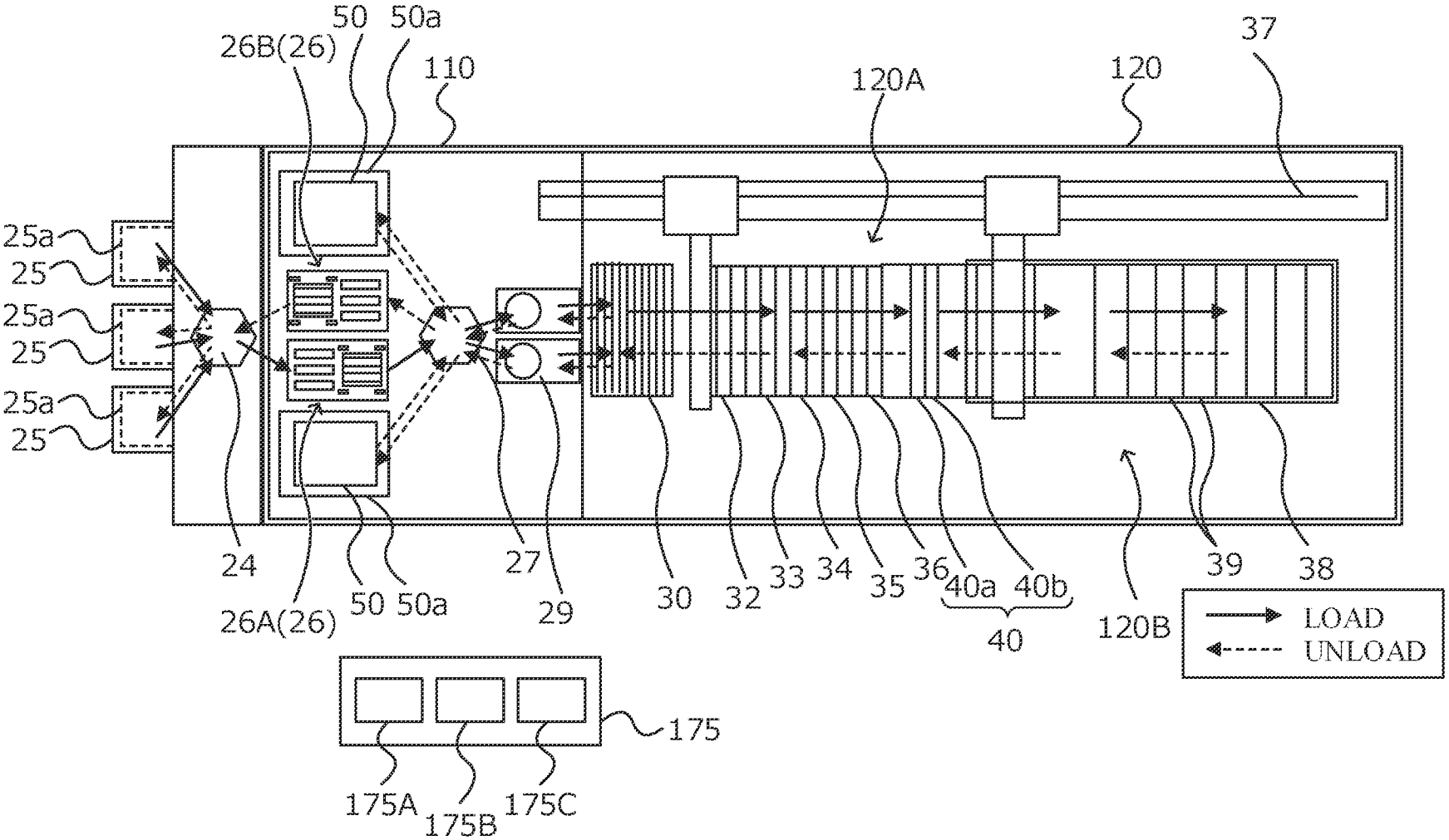
FIG. 1 is an overall layout of a plating apparatus according to an embodiment of the present invention.

FIG. 1 is an overall layout of a plating apparatus according to an embodiment of the present invention. A plating apparatus 100 is roughly divided into a load/unload module 110 that loads a substrate on a substrate holder (not shown) or unloading the substrate from the substrate holder, a treatment module 120 that treats the substrate, and a cleaning module 50*a*. The treatment module 120 further includes a pretreatment; posttreatment module 120A that performs pretreatment and posttreatment of the substrate, and a plating treatment module 120B that plates the substrate. Note that the substrate includes a square substrate and a circular substrate. Also, the square substrate includes a glass substrate in a polygonal shape such as a rectangular shape, a liquid crystal substrate, a printed board, and another polygonal substrate. The circular substrate includes a semiconductor wafer, a glass substrate, and another circular substrate to be treated.

The load/unload module 110 includes a substrate arrangement adjustment mechanism 26, a substrate transport device 27, and a fixing station 29. As an example, in the present embodiment, the load/unload module 110 includes two substrate arrangement adjustment mechanisms 26 including a loading substrate arrangement adjustment mechanism 26A that handles the substrate before treated, and an unloading substrate arrangement adjustment mechanism 26B that handles the treated substrate. In the present embodiment, the loading substrate arrangement adjustment mechanism 26A and the unloading substrate arrangement adjustment mechanism 26B include the same configuration, and are arranged in orientations that are 180° different from each other. Note that the substrate arrangement adjustment mechanism 26 is not limited to the mechanism including the loading and unloading substrate arrangement adjustment mechanisms 26A and 26B, and the mechanisms may be used without being distinguished for loading and unloading. Further, in the present embodiment, the load/unload module 110 includes two fixing stations 29. The two fixing stations 29 have the same mechanism, and a vacant station (station that does not handle the substrate) is used. Note that one or three or more substrate arrangement adjustment mechanisms 26 and one or three or more fixing stations 29 may be provided depending on a space in the plating apparatus 100.

Substrates are transported from a plurality of (as an example, in FIG. 1, three) cassette tables 25 through a robot 24 to the substrate arrangement adjustment mechanism 26 (the loading substrate arrangement adjustment mechanism 26A). Each cassette table 25 includes a cassette 25*a* that stores substrates. The cassette is, for example, a hoop. The substrate arrangement adjustment mechanism 26 is configured for adjustment (alignment) of a position and orientation of each mounted substrate. The substrate transport device 27 that transports the substrate between the substrate arrangement adjustment mechanism 26 and the fixing station 29 is disposed therebetween. The substrate transport device 27 is configured to transport the substrate among the substrate arrangement adjustment mechanism 26, the fixing station 29, and a cleaning device 50. Also, a stocker 30 for storing the substrate holder is disposed in the vicinity of the fixing station 29.

The cleaning module 50*a* includes the cleaning device 50 that cleans and dries the plated substrate. The substrate transport device 27 is configured to transports the plated substrate to the cleaning device 50, and take out the cleaned substrate from the cleaning device 50. Then, the cleaned substrate is transferred to the substrate arrangement adjustment mechanism 26 (unloading substrate arrangement adjustment mechanism 26B) by the substrate transport device 27, and returned to the cassette 25*a* through the robot 24.

The pretreatment/posttreatment module 120A includes a prewet tank 32, a presoak tank 33, a prerinse tank 34, a blow tank 35, a rinse tank 36, and a thief electrode maintenance tank 40. In the prewet tank 32, the substrate is immersed in pure water. In the presoak tank 33, an oxide film on a surface of a conductive layer such as a seed layer formed on the surface of the substrate is removed by etching. In the prerinse tank 34, the presoaked substrate is cleaned together with the substrate holder in a cleaning solution (pure water or the like). In the blow tank 35, the cleaned substrate is drained. In the rinse tank 36, the plated substrate is cleaned together with the substrate holder in the cleaning solution. In the thief electrode maintenance tank 40, maintenance of an after-mentioned thief electrode is performed. Note that this configuration of the pretreatment; posttreatment module 120A of the plating apparatus 100 is merely an example, the configuration of the pretreatment/posttreatment module 120A of the plating apparatus 100 is not restricted, and other configurations may be employed.

The plating apparatus 100 includes a transporter 37 located on a side of the pretreatment/posttreatment module 120A and the plating treatment module 120B to transport the substrate holder together with the substrate, and in the transporter, for example, a linear motor system is employed. The transporter 37 transports the substrate holder among the fixing station 29, the stocker 30, the prewet tank 32, the presoak tank 33, the prerinse tank 34, the blow tank 35, the rinse tank 36, and a plating tank 39.

The plating apparatus 100 including the above configuration includes a controller 175 that is configured to control the respective modules. The controller 175 includes a memory 175B that stores various setting data and various programs, a CPU 175A that executes the program of the memory 175B, and a control module 175C achieved by the CPU 175A that executes the program. A recording medium included in the memory 175B includes one or a plurality of arbitrary recording mediums including a ROM, RAM, hard disk, CD-ROM, DVD-ROM, and flexible disk. Examples of the program stored in the memory 175B include program to control transport of the transporter 37, and program to control a plating treatment in each plating tank 39. Also, the controller 175 is configured to communicate with an unshown upper controller that generally controls the plating apparatus 100 and other related apparatuses, and can exchange data with database included in the upper controller.

Figure 2:
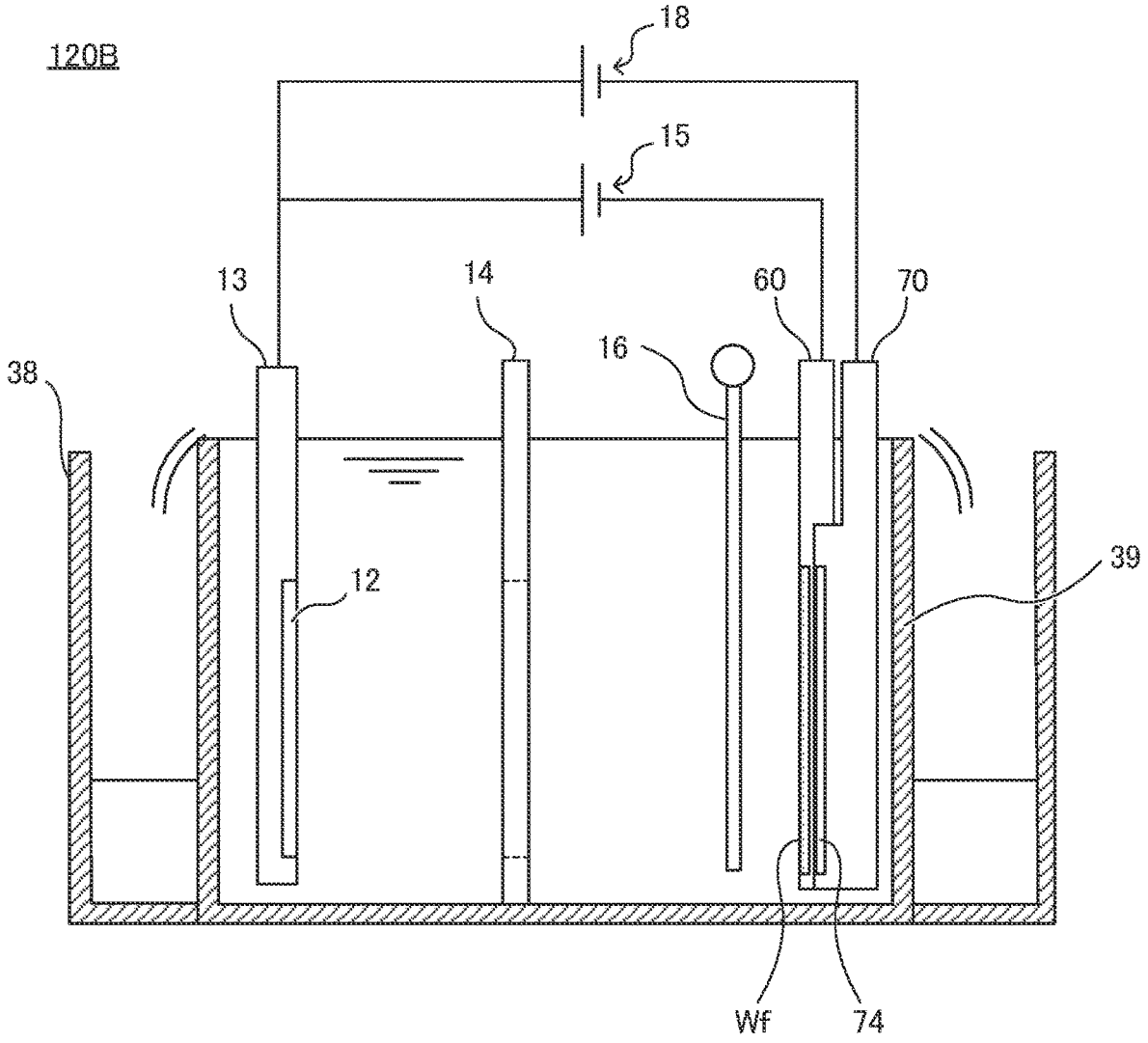
FIG. 2 is a schematic side cross-sectional view (vertical sectional view) of a plating treatment module disposed in the plating apparatus shown in FIG. 1.

FIG. 2 is a schematic side cross-sectional view (vertical sectional view) of the plating treatment module 120B disposed in the plating apparatus shown in FIG. 1. As shown in FIG. 2, the plating treatment module 120B includes the plating tank 39 that stores the plating solution, a substrate holder 60, and an anode holder 13, and an overflow tank 38 that stores the plating solution that overflows the plating tank 39. The substrate holder 60 is configured to hold a substrate Wf that is a plating treatment target, and the anode holder 13 is configured to hold an anode 12 hawing a metal surface. The substrate Wf and the anode 12 are electrically connected via a plating power supply 15, and current is supplied to flow between the substrate Wf and the anode 12, thereby forming a plating film on a surface of the substrate Wf.

Also, the plating treatment module 120B includes a regulation plate (adjustment plate) 14 for regulating electric field between the substrate Wf and the anode 12, and a paddle 16 for stirring the plating solution. The regulation plate 14 is disposed between the substrate holder 60 and the anode 12. The paddle 16 is disposed between the substrate holder 60 and the regulation plate 14.

Figure 3:
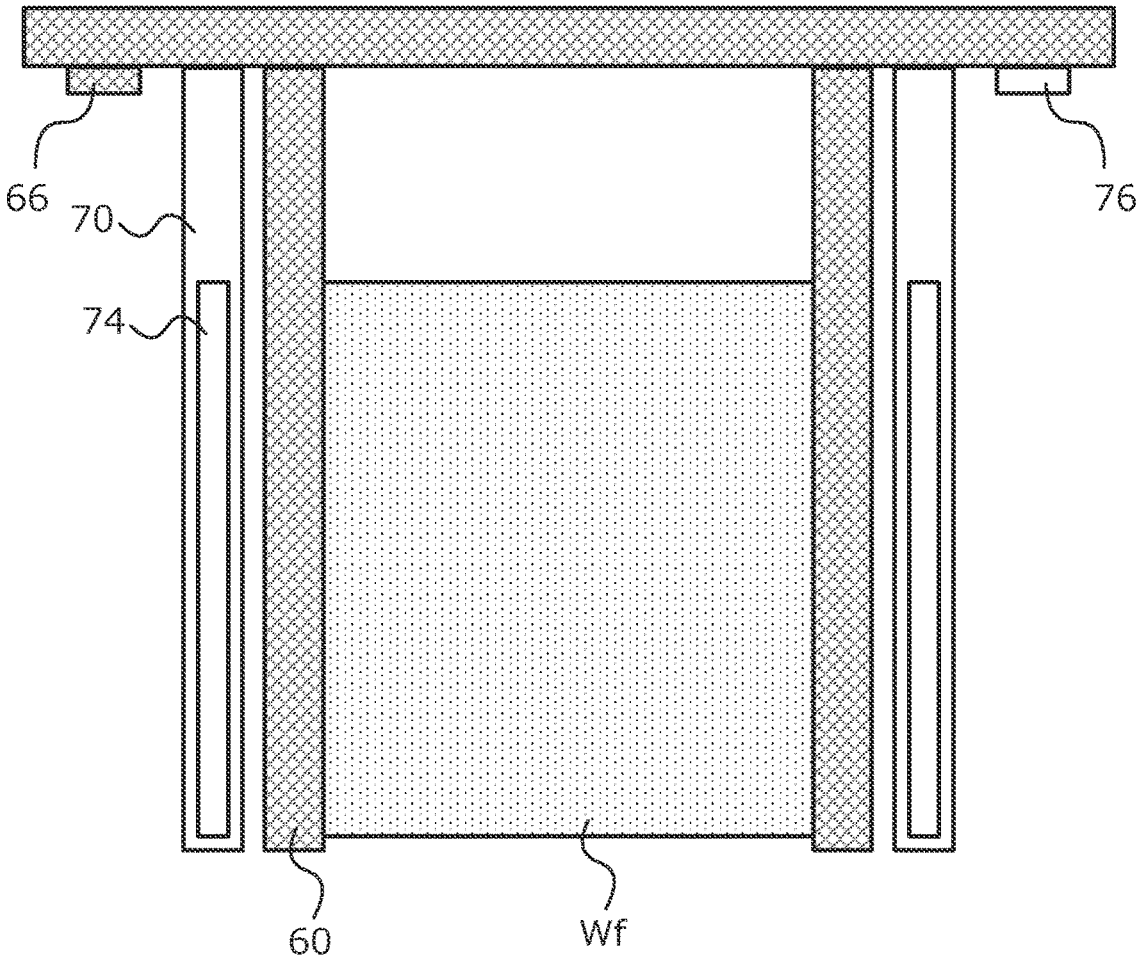
FIG. 3 is a view showing an example including a substrate holder and a thief electrode supporter as seen from an anode side.
Figure 4:
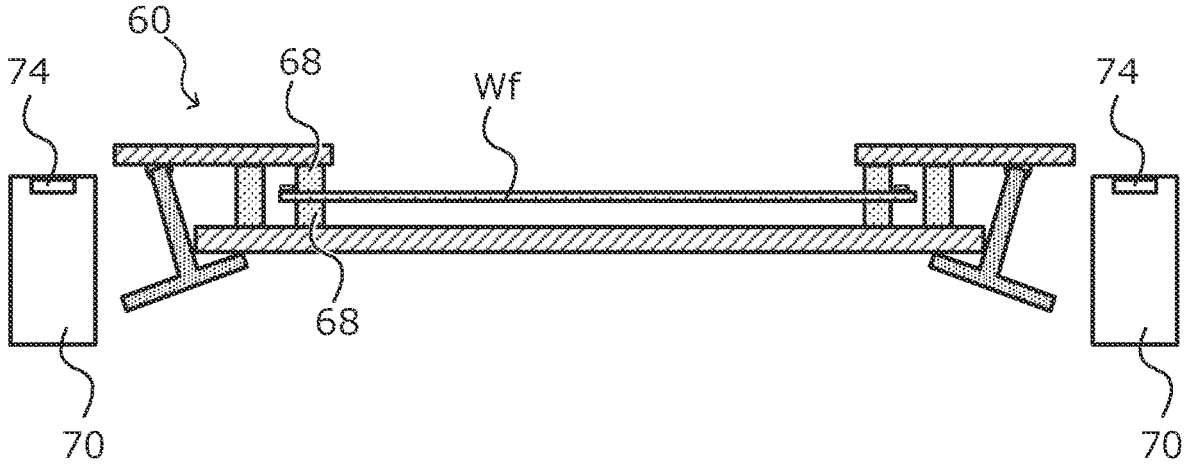
FIG. 4 is a cross-sectional view showing the substrate holder and the thief electrode supporter of the present embodiment as viewed from above in FIG. 3.

The substrate holder 60 is configured to hold the substrate Wf in the plating tank 39. Also, the plating treatment module 120B includes a thief electrode supporter 70 that is a member separate from the substrate holder 60. The thief electrode supporter 70 supports a thief electrode 74, and the thief electrode 74 and the anode 12 are electrically connected via a power supply 18. FIG. 3 is a view showing an example including the substrate holder and the thief electrode supporter as seen from an anode 12 side, and FIG. 4 is a cross-sectional view viewed from above in FIG. 3. Note that FIG. 3 shows the substrate holder 60 shaded with hatching for ease of understanding. In the example shown in FIGS. 3 and 4, the substrate Wf is a square substrate having a rectangular plate surface, and the substrate holder 60 is configured to hold and support two opposite sides (two sides extending in an up-down direction in FIG. 3) of the square substrate. As a more specific example, the substrate holder 60 holds the substrate Wf with a part of the surface of the substrate Wf to be plated being exposed while sandwiching an edge portion that is an outer region of the part, between the surface to be plated and a back surface of the substrate. The substrate holder 60 includes a seal body 68 that seals the edge portion so that the plating solution does not act on the edge portion of the substrate Wf.

Figure 5:
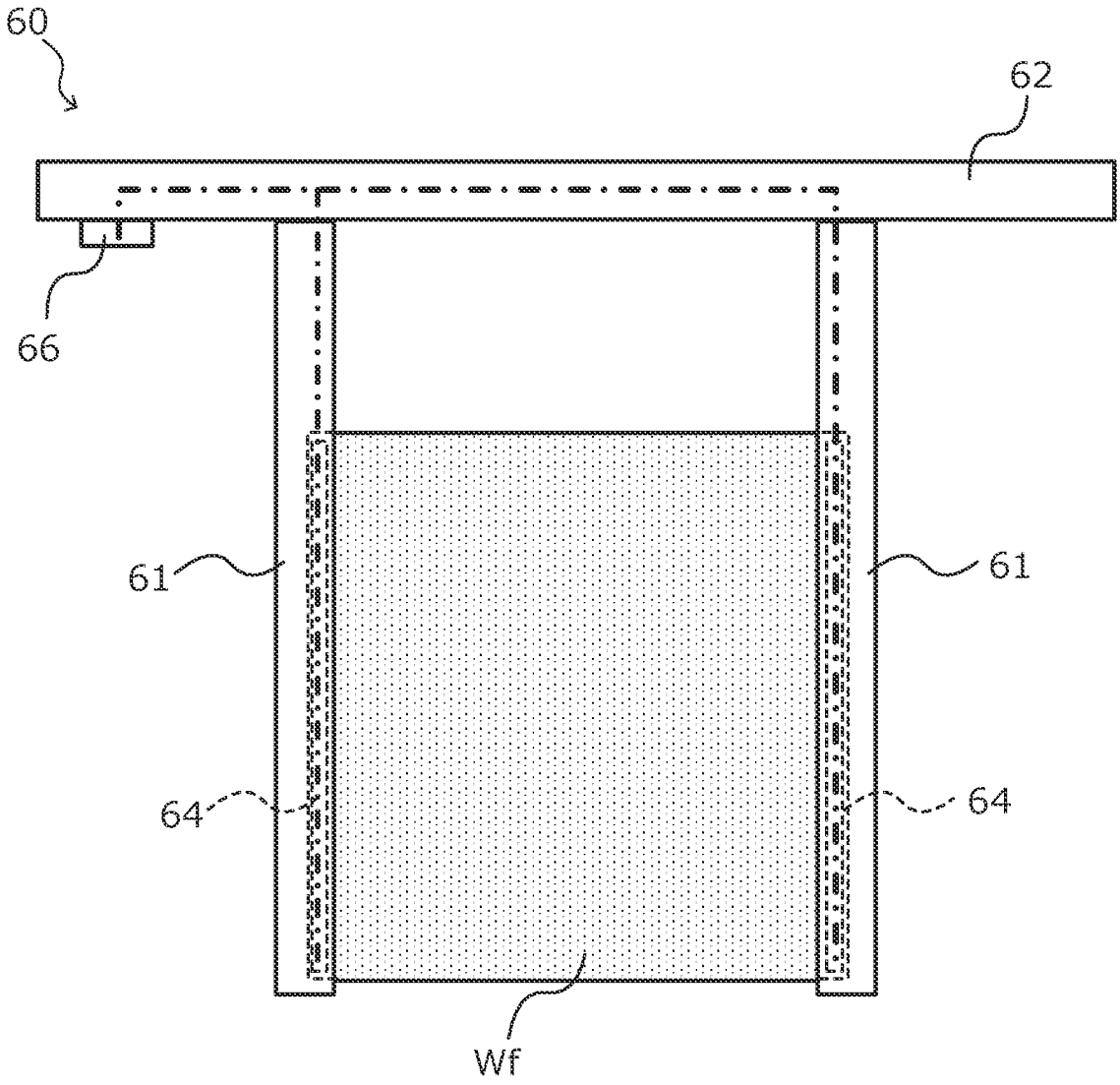
FIG. 5 is a view showing the substrate holder in FIG. 3.

FIG. 5 is a view showing the substrate holder in FIG. 3. Note that FIG. 5 shows an electric wiring in the substrate holder 60 with a dashed line. As shown in FIGS. 3 and 5, the substrate holder 60 includes a main body part 61 configured to hold the substrate Wf, and an arm part 62 disposed at an upper end of the main body part 61. The substrate holder 60 is transported in a state where the arm part 62 is held with the transporter 37. As shown with a broken line in FIG. 5, the main body part 61 includes electric contacts 64 for supplying power to two opposite sides of the square substrate. Each electric contact 64 is configured to be in contact with the whole edge portion of the substrate Wf Note that in the example shown in FIG. 5, the electric contacts 64 are two parallel long members, but are not limited to this example, and may be formed in a rectangular shape so that power can be supplied to four sides of the square substrate. Also, in a case where the substrate Wf has a circular shape or a polygonal shape such as a hexagonal shape, the electric contact may be formed in a ring shape or a polygonal shape depending on the shape of the substrate. The electric contacts 64 are electrically connected to a power supply contact 66 disposed in the arm part 62. In the present embodiment, as shown in FIG. 5, the power supply contact 66 is disposed on one end side (left side in FIGS. 3 and 5) of the arm part 62. However, the present invention is not limited to this example, and the power supply contact 66 may be disposed at each of opposite ends of the arm part 62.

Figure 6:
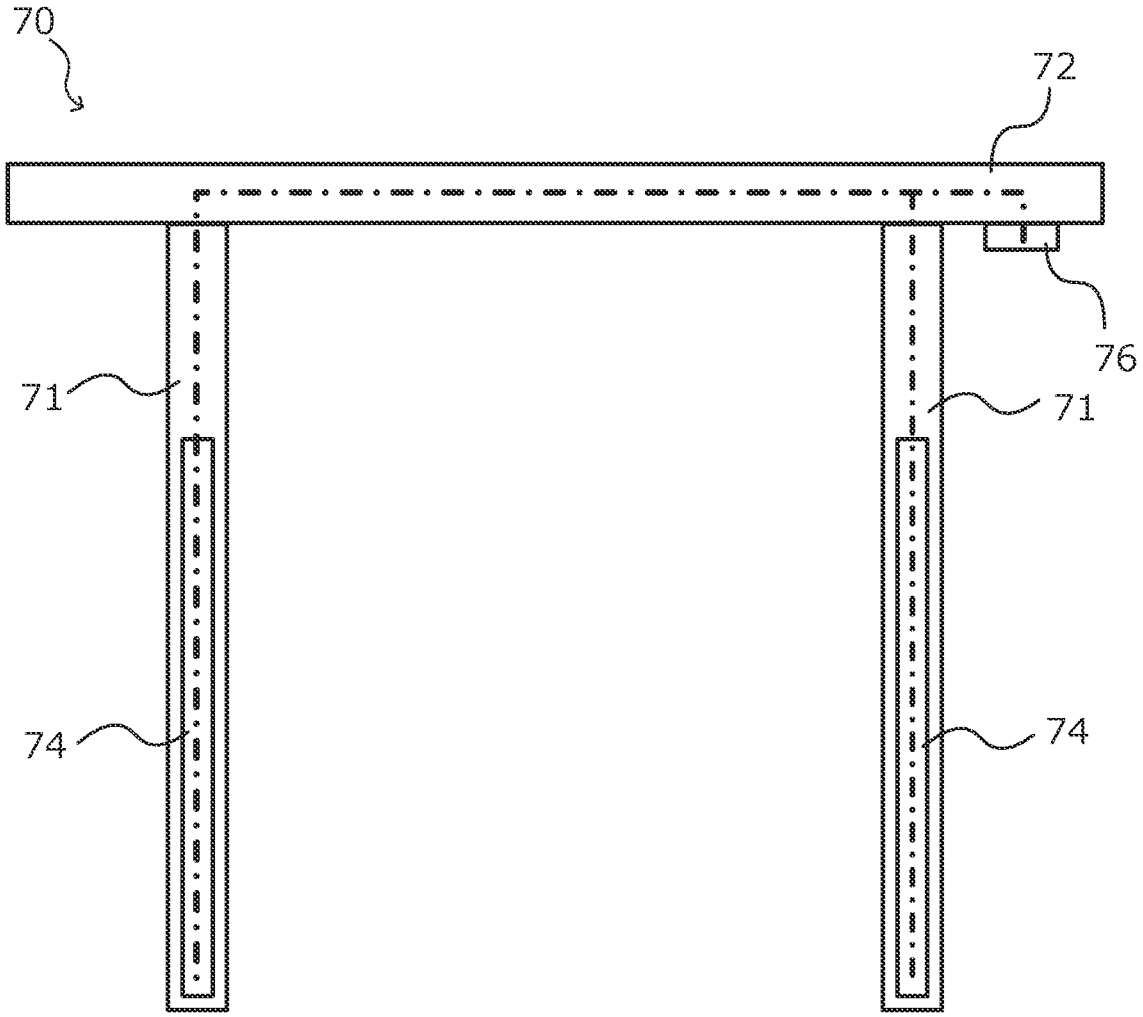
FIG. 6 is a view showing the thief electrode supporter in FIG. 3.
Figure 7:
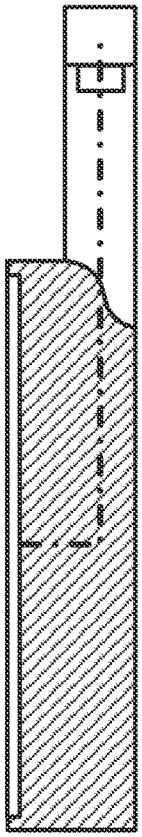
FIG. 7 is a side view showing the thief electrode supporter in the present embodiment as seen from a side.
Figure 8:
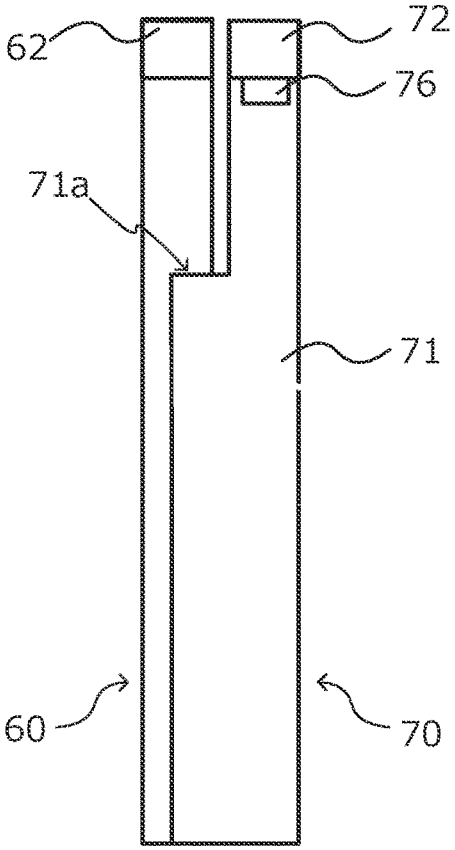
FIG. 8 is a side view showing the substrate holder and the thief electrode supporter in the present embodiment.

As shown in FIGS. 3 and 4, the thief electrode supporter 70 supports the thief electrode 74 to be disposed outside the substrate Wf. The thief electrode supporter 70 is configured as the member separate from the substrate holder 60. FIG. 6 is a view showing the thief electrode supporter 70 in FIG. 3. Also, FIG. 7 is a side view showing the thief electrode supporter 70 in the present embodiment as seen from a side, and FIG. 8 is a side view showing the substrate holder 60 and the thief electrode supporter 70 in the present embodiment. Note that FIGS. 6 and 7 show an electric wiring in the thief electrode supporter 70 with a dashed line. Also, FIG. 7 schematically shows an inner cross section of a portion of a main body part 71 of the thief electrode supporter 70. The thief electrode supporter 70 includes the main body part 71 provided with the thief electrode 74, and an arm part 72 disposed at an upper end of the main body part 71. Here, the thief electrode supporter 70 may be configured to be transportable by the transporter 37. As an example, the arm part 72 of the thief electrode supporter 70 may be configured with the same dimension as a dimension of the arm part 62 of the substrate holder 60. Also, as shown in FIGS. 7 and 8, the main body part 71 of the thief electrode supporter 70 includes a protruding portion 71*a* protruding forward (to the anode side). Here, it is preferable that the protruding portion 71*a* is configured to not to protrude forward from a front end (anode side end) of the substrate holder 60, that is, configured to be located rearward from the front end of the substrate holder 60. In this case, the paddle 16 can be inhibited from interfering with the thief electrode supporter 70, and flow of the plating solution around the surface to be plated can be inhibited from being blocked by the thief electrode supporter 70. However, the present invention is not limited to this example, and as an example, the thief electrode supporter 70 may have a front end flush with the front end of the substrate holder 60, or protruding forward from the front end of the substrate holder 60. Alternatively, the thief electrode supporter 70 may have the front end flush with the surface of the substrate Wf to be plated.

As shown in FIGS. 3 and 4, in the present embodiment, the thief electrode 74 is disposed along the electric contact 64 of the substrate holder 60, The thief electrode 74 may have a shape and dimension suitably determined depending on a shape of the electric contact 64 of the substrate holder 60 or the substrate Wf. As shown in FIG. 6, the thief electrode 74 is electrically connected to a power supply contact 76 disposed in the arm part 72. In the present embodiment, the power supply contact 76 of the thief electrode supporter 70 is disposed on the other end side (right side in FIG. 3) that is a side opposite to one end side (left side in FIG. 3) on which the power supply contact 66 is disposed in the substrate holder 60, Thus, the power supply contact 66 of the substrate holder 60 is disposed on one end side, and the power supply contact 76 of the thief electrode supporter 70 is disposed on the other end side. Consequently, even if the substrate holder 60 and the thief electrode supporter 70 are arranged at wrong positions in the plating tank 39, malfunction can be inhibited from occurring. However, the present invention is not limited to this example, and the power supply contact 76 of the thief electrode supporter 70 may be disposed on the same side as the side of the power supply contact 66 of the substrate holder 60, or may be disposed at each of opposite ends of the arm part 72.

Note that in the present embodiment, as shown in FIG. 4, a surface of the thief electrode 74 is configured to be located forward from the surface of the substrate Wf to be plated (on the anode side) in the plating tank 39. However, the present invention is not limited to this example, and the surface of the thief electrode 74 may be flush with the surface of the substrate Wf to be plated, or the surface of the thief electrode 74 may be located rearward from the surface of the substrate Wf to be plated (far from the anode).

Here, description will be made as to roles of the substrate holder 60 and the thief electrode supporter 70 in the plating apparatus 100. As described above, the substrate holder 60 is configured to hold the substrate Wf, and is transported among the fixing station 29, the stocker 30, the prewet tank 32, the presoak tank 33, the prerinse tank 34, the blow tank 35, the rinse tank 36, and the plating tank 39 by the transporter 37. When the substrate holder 60 is transported to respective treatment tanks and immersed in a treatment solution in each treatment tank, the arm part 62 is disposed on an arm receiving member (not shown) of each treatment tank. When the substrate holder 60 is disposed in the plating tank 39, the power supply contact 66 disposed in the arm part 62 comes in contact with an electric contact (not shown) disposed in the arm receiving member of the plating tank 39. Consequently, when power is supplied from the plating power supply 15 (see FIG. 2), current flows between the substrate Wf and the anode 12, and the plating film can be formed on the surface of the substrate Wf to be plated.

Also, during the plating treatment, the thief electrode supporter 70 is disposed together with the substrate holder 60 in the plating tank 39. In the present embodiment, the thief electrode supporter 70 is transported between the plating tank 39 and the thief electrode maintenance tank 40 by the transporter 37. In the present embodiment, the arm part 72 of the thief electrode supporter 70 is disposed on an arm receiving member (not shown) of each tank in the same manner as in the substrate holder 60. Note that the transporter 37 may be configured to transport the substrate holder 60 together with the thief electrode supporter 70, or selectively transport one of the substrate holder 60 and the thief electrode supporter 70. In the present embodiment, the transporter 37 corresponds to "a transport module". However, the plating apparatus 100 may include a transport module exclusively for transporting the thief electrode supporter 70 separately from the transporter 37.

When the thief electrode supporter 70 is disposed in the plating tank 39, the power supply contact 76 disposed in the arm part 72 comes in contact with an electric contact (not shown) disposed in the arm receiving member of the plating tank 39. Consequently, during the plating treatment, power from the power supply 18 (see FIG. 2) is supplied, and current can be supplied to flow between the thief electrode 74 and the anode 12. In the present embodiment, the electric contact 64 of the substrate holder 60 is disposed in contact with a peripheral edge portion of the substrate Wf, and a lower potential is generated in the peripheral edge portion of the substrate Wf than in a central portion of the substrate Wf, Consequently, reduction current of metal ions is likely to concentrate in the peripheral edge portion of the substrate Wf. On the other hand, when current is supplied to flow between the thief electrode 74 and the anode 12 during the plating treatment, part of reduction current of metal ions flowing through the peripheral edge portion of the substrate Wf can be supplied to flow toward the thief electrode 74, and hence uniformity in film thickness of the plating film formed on the substrate Wf can improve.

The thief electrode 74 has a metal film (plating) deposited by the plating treatment, and is therefore preferably maintained at appropriate timing (e.g., when used predetermined times or for a predetermined time). According to the present embodiment, the plating apparatus 100 can apply a maintenance treatment of the thief electrode 74 in the thief electrode maintenance tank 40. As an example, the thief electrode maintenance tank 40 may include a peel tank 40*a* and a rinse tank 40*b* (see FIG. 1). In the peel tank 40*a*, a treatment for peeling the metal film from the thief electrode 74 is applied. As an example, in the peel tank 40*a*, the plating solution is stored, and a reverse electrolysis treatment is applied by supplying current in a direction opposite to a direction of current in the plating treatment, that is, supplying current to the thief electrode as an anode, between the thief electrode 74 and an electrode (not shown) in the peel tank 40*a*. Note that in a case where the plating solution is stored in the peel tank 40*a*, the peel tank 40*a* may be housed together with the plating tank 39 in the overflow tank 38. Alternatively, as another example, in the peel tank 40*a*, a chemical solution for dissolving the metal film deposited on the thief electrode 74 may be stored, and the thief electrode 74 may be immersed in the chemical solution, thereby peeling the metal film. As still another example, the peel tank 40*a* may include a mechanism configured to be physically in contact with the thief electrode 74 and scrape off the metal film deposited on the surface of the electrode. In the rinse tank 40*b*, the thief electrode 74 from which the metal film is peeled is cleaned together with the thief electrode supporter 70 with the cleaning solution (pure water or the like). Here, in the present embodiment, the thief electrode supporter 70 supporting the thief electrode 74 is configured as the member separate from the substrate holder 60, and the thief electrode supporter 70 can be maintained alone. Consequently, the substrate holder 60 can be prevented, for example, from being deteriorated or damaged in the thief electrode maintenance tank 40. Also, when the maintenance of the thief electrode 74 and the transport of the substrate holder 60 are separately performed, an entire treatment velocity in the plating apparatus 100 can be increased.

Modification

Figure 9:
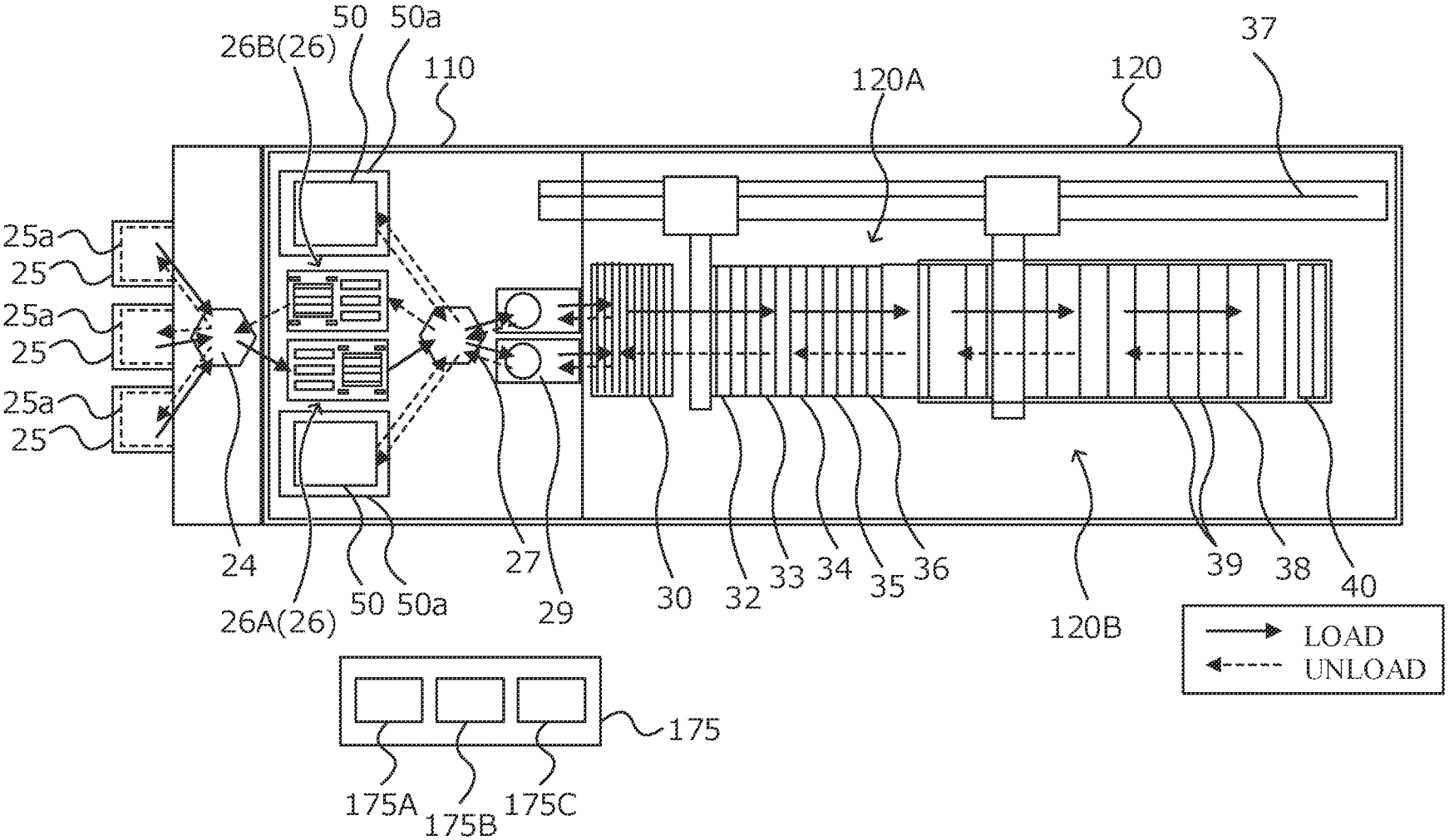
FIG. 9 is an overall layout of a plating apparatus according to a modification.

FIG. 9 is an overall layout of a plating apparatus according to a modification. In the above example shown in FIG. 1, the thief electrode maintenance tank 40 is disposed between the fixing station 29 and the plating tank 39. On the other hand, in an example shown in FIG. 9, the thief electrode maintenance tank 40 is disposed farther from the fixing station 29 than from the plating tank 39. In other words, the plating tank 39 is disposed between the fixing station 29 and the thief electrode maintenance tank 40. According to such arrangement, the fixing station 29 can be located closer to the plating tank 39, and a distance along which the substrate holder 60 is transported by the transporter 37 can be shortened.

The present embodiment described above can be described in the following aspects.

[Aspect 1]

According to aspect 1, a plating apparatus is provided, and the plating apparatus includes a substrate holder holding a substrate, a thief electrode supporter supporting a thief electrode to be disposed outside the substrate, a plating tank configured to immerse the substrate in a plating solution for applying an electroplating treatment, a thief electrode maintenance tank configured to perform maintenance of the thief electrode, and a transport module configured to transport the thief electrode supporter to the plating tank and the thief electrode maintenance tank. According to aspect 1, the thief electrode can be suitably maintained.

[Aspect 2]

According to aspect 2, in aspect 1, the transport module is configured to transport the substrate holder. According to aspect 2, the transport module can transport each of the substrate holder and the thief electrode supporter.

[Aspect 3]

According to aspect 3, in aspect 2, the transport module is configured to selectively transport one of the substrate holder and the thief electrode supporter.

[Aspect 4]

According to aspect 4, in aspects 1 to 3, the plating apparatus further includes a fixing station for detachably attaching the substrate to the substrate holder, wherein the plating tank is disposed between the fixing station and the thief electrode maintenance tank. According to aspect 4, the fixing station can be located closer to the plating tank.

[Aspect 5]

According to aspect 5, in aspects 1 to 3, the plating apparatus further includes a fixing station for detachably attaching the substrate to the substrate holder, wherein the thief electrode maintenance tank is disposed between the fixing station and the plating tank.

[Aspect 6]

According to aspect 6, in aspects 1 to 5, in the thief electrode maintenance tank, current is supplied to flow between the thief electrode and a maintenance electrode, to perform a peeling treatment of plating adhered on a surface of the thief electrode.

[Aspect 7]

According to aspect 7, in aspects 1 to 6, in the thief electrode maintenance tank, the thief electrode is immersed in a chemical solution for dissolving plating, to perform a peeling treatment of the plating adhered on a surface of the thief electrode.

[Aspect 8]

According to aspect 8, in aspects 1 to 7, the substrate is a square substrate, the substrate holder includes an electric contact configured to supply power to two opposite sides of the square substrate, and the thief electrode is disposed along the two opposite sides outside the substrate.

Several embodiments of the present invention have been described above, and the above embodiments of the invention are intended to facilitate understanding of the present invention, and are not intended to restrict the present invention. The present invention may be changed or modified without departing from the gist, and needless to say, the present invention includes equivalents. Further, in a range in which at least some of the above problems can be solved, or a range in which at least some of effects can be exhibited, arbitrary combination or omission of respective components described in claims and description is possible.

The present application is based on and claims the benefit of priority of Japanese Patent Application No. 2020-175956 filed on Oct. 20, 2020. All disclosed contents including the description, claims, drawings and abstract of Japanese Patent Application No. 2020-175956 are entirely incorporated herein by reference. All disclosure including the description, claims, drawings and abstract of U.S. Pat. No. 5,620,581 (Patent Literature 1) is entirely incorporated herein by reference.

REFERENCE SIGNS LIST

Wf substrate
12 anode
26 substrate arrangement adjustment mechanism
27 substrate transport device
29 fixing station
32 prewet tank
33 presoak tank
34 prerinse tank
35 blow tank
36 rinse tank
37 transporter
38 overflow tank
39 plating tank
40 thief electrode maintenance tank
40*a* peel tank
40*b* rinse tank
50 cleaning device
60 substrate holder
61 main body part
62 arm part
64 electric contact
66 power supply contact
68 seal body
70 thief electrode supporter
71 main body part
71*a* protruding portion
72 arm part
74 thief electrode
76 power supply contact
100 plating apparatus

What is claimed is:

1. A plating apparatus comprising:

a substrate holder holding a substrate, a thief electrode supporter supporting a thief electrode to be disposed outside the substrate, a plating tank configured to immerse the substrate in a plating solution for applying an electroplating treatment, a thief electrode maintenance tank configured to perform maintenance of the thief electrode, and a transport module configured to transport the thief electrode supporter to the plating tank and the thief electrode maintenance tank, wherein the substrate holder comprises a first arm part supported by the plating tank during the electroplating treatment, the thief electrode supporter comprises a second arm part supported by the plating tank during the electroplating treatment, and the transport module transports the substrate holder by holding the first arm part, and transports the thief electrode supporter by holding the second arm part.

2. The plating apparatus according to claim 1, wherein the second arm part is configured with the same dimension as a dimension of the first arm part.

3. The plating apparatus according to claim 2, wherein the first arm part is provided with a first power supply contact for supplying power to the substrate holder, and the second arm part is provided with a second power supply contact for supplying power to the thief electrode supporter.

4. The plating apparatus according to claim 1, further comprising:

a fixing station for detachably attaching the substrate to the substrate holder, wherein the plating tank is disposed between the fixing station and the thief electrode maintenance tank.

5. The plating apparatus according to claim 1, further comprising:

a fixing station for detachably attaching the substrate to the substrate holder, wherein the thief electrode maintenance tank is disposed between the fixing station and the plating tank.

6. The plating apparatus according to claim 1, wherein in the thief electrode maintenance tank, current is supplied to flow between the thief electrode and a maintenance electrode, to perform a peeling treatment of plating adhered on a surface of the thief electrode.

7. The plating apparatus according to claim 1, wherein in the thief electrode maintenance tank, the thief electrode is immersed in a chemical solution for dissolving plating film, to perform a peeling treatment of the plating adhered on a surface of the thief electrode.

8. The plating apparatus according to claim 1, wherein the substrate is a square substrate, the substrate holder includes an electric contact configured to supply power to two opposite sides of the square substrate, and the thief electrode is disposed along the two opposite sides outside the substrate.

* * * * *